US006196282B1

(12) United States Patent
Möllers

(10) Patent No.: US 6,196,282 B1
(45) Date of Patent: Mar. 6, 2001

(54) FILLING DEVICE FOR CARTRIDGES

(75) Inventor: Renko Möllers, Sassenberg (DE)

(73) Assignee: Technotrans AG, Sassenberg (DE)

( * ) Notice: Subject to any disclaimer, the term of this patent is extended or adjusted under 35 U.S.C. 154(b) by 0 days.

(21) Appl. No.: 09/422,285

(22) Filed: Oct. 21, 1999

(30) Foreign Application Priority Data

Nov. 20, 1998 (DE) ..... 198 53 593

(51) Int. Cl.[7] ..... B65B 39/06

(52) U.S. Cl. ..... 141/385; 141/18; 141/113; 141/383

(58) Field of Search ..... 141/2, 18, 21, 141/113, 383, 385

(56) References Cited

U.S. PATENT DOCUMENTS

| | | | | |
|---|---|---|---|---|
| 1,711,870 | * | 5/1929 | Zerk | 141/385 |
| 5,247,972 | * | 9/1993 | Tetreault | 141/383 |
| 5,379,812 | * | 1/1995 | McCunn et al. | 141/18 |
| 5,472,022 | * | 12/1995 | Michel et al. | 141/383 |
| 5,758,700 | * | 6/1998 | Vanderploeg | 141/113 |

FOREIGN PATENT DOCUMENTS

| | | |
|---|---|---|
| 93 05 449 U | 7/1993 | (DE) . |
| 19705201 | 4/1998 | (DE) . |

* cited by examiner

*Primary Examiner*—J. Casimer Jacyna
(74) *Attorney, Agent, or Firm*—Richard M. Goldberg

(57) ABSTRACT

A filling device for cartridges with an annular outlet opening (20) inside a cartridge neck (14), in the center of which there is a fixed center element (18), includes a valve cap (34) that is shiftable disposed on the neck (14) which, in a first position into which valve cap (34) is pretensioned, covers over annular outlet opening (20) by means of an inwardly projecting annular flange (38) and, in a second position, uncovers outlet opening (20). The filling device includes:

a cylindrical filling nozzle (12) with a concentric feed bore (52) for filling material inside, a sealing sleeve (46) that encloses filling nozzle (12) concentrically and can be displaced longitudinally in relation to the filling nozzle, claws (40) on an end portion of filling nozzle (12) destined to come into contact with the cartridges, which grip valve cap (34) and move it into the open position as a result of the filling nozzle (12) being pulled back, and a drive assembly for independently displacing the filling nozzle (12) and/or sealing sleeve (46) longitudinally.

According to one especially advantageous embodiment, a vacuum can be created in the transition area between the filling device and the cartridge to include the whole cartridge, before the filling operation begins. As a result, used cartridges can be refilled without any of the problems associated with air remaining inside the cartridge. The piston is pushed back to the base of the cartridge by the pressure of the incoming filling material.

20 Claims, 2 Drawing Sheets

FILLING DEVICE FOR CARTRIDGES

BACKGROUND OF THE INVENTION

The invention relates to a filling device for cartridges with an annular outlet opening inside a cartridge neck, in the centre of which there is a fixed centre element, comprising a valve cap that is shiftable disposed on the neck which, in a first position into which the valve cap is pretensioned, covers over the annular outlet opening by means of an inwardly projecting annular flange and, in a second position, uncovers the outlet opening.

The invention relates in particular to a filling device for valve cartridges of the type described in DE 197 05 201 C1. Cartridges are used to hold printing inks for printing machines, as well as other pasty materials too, such as silicon and adhesives etc. Said cartridge has a valve cap which is disposed so that it can be displaced longitudinally along the neck of the cartridge, and which opens or closes an annular outlet opening of the cartridge by means of an annular, inwardly projecting edge flange. The valve cap is pretensioned to adopt the closed position and hence it opens automatically when a pressure of sufficient magnitude is exercised by a piston disposed in the cartridge, and closes automatically in the absence of this pressure.

Prior art filling devices for cartridges which operate on an industrial scale are very complicated and expensive, and hence are only financially viable when there are a large number of cartridges to be filled consecutively with the same pasty mass. Only large manufacturers of inks or adhesives meet these prerequisites. To quote just one example, filling cartridges with special colours are not, therefore, a very attractive proposition for large ink manufacturers who use industrial filling technology because the users only require small batches. Furthermore, it is also very difficult for large ink manufacturers to respond flexibly to urgent inquiries.

SUMMARY OF THE INVENTION

The invention is therefore based on the task of creating a filling device which is of a relatively simple construction and inexpensive to manufacture, and which is financially viable even for relatively small batches.

In a filling device of the above-mentioned type, this task is solved in that the device comprises

- a cylindrical filling nozzle with a concentric feed bore for filling material inside,
- sealing sleeve that encloses the filling nozzle concentrically and can be displaced longitudinally in relation to the filling nozzle,
- claws on the end portion of the filling nozzle destined to come into contact with the cartridges, which grip the valve cap and move it into the open position as a result of the filling nozzle being pulled back, and
- drive means for independently displacing the filling nozzle and/or the sealing sleeve longitudinally.

During the filling process one cartridge at a time is brought up against the filling nozzle. The sealing sleeve is then pushed forwards over the transition area from the filling nozzle to the cartridge against the front of the cartridge, so that this portion is completely sealed off towards the outside. The filling nozzle is pulled back slightly, whereupon the claws grip the valve cap and pull the valve cap down into the open position. This is the position in which the filling operation can start.

The claws preferably have a cam surface on their radial-outer side, which, when the sealing sleeve is pushed forward towards the cartridge, comes into contact with the sealing sleeve so that the claws are pushed inwards and engage behind the valve cap with hook-like projections. The claws are elastically pretensioned outwards, so that they only engage with the valve cap when the sealing sleeve is pushed completely forwards.

The filling nozzle has an annular seal at the end closest to the cartridge.

In some instances it may be necessary, or at least expedient, to conduct the filling operation under considerably reduced pressure, or a vacuum.

This will be the case, for example, when the piston inside the cartridge has to be pulled back into the starting position. Hence the device according to the invention can also be equipped with means for producing such a vacuum.

Filling cartridges under vacuum offers significant added advantages, and opens up possibilities that could not previously be exploited. To start with, there are no more of the difficulties associated with evacuating air remaining in the cartridge during the filling operation. Used cartridges can be refilled twice and repeatedly. The vacuum works by pulling the piston in the cartridge to the outlet end, from where it is pushed right back to the base of the cartridge by the pressure of the incoming mass. Hence the cartridge can be refilled without removing or damaging the piston. As the cartridges can be repeatedly reused instead of being thrown away once they are empty, as is otherwise usual, the number of cartridges for disposal can be considerably reduced. This means that the same cartridges can be reused for the same type of mass, colour etc., in particular for special colours or other viscous masses which are needed regularly, but only in relatively small quantities.

The vacuum in the filling device and the cartridge can be created in a variety of ways.

It is preferable to provide at least one vacuum channel which, starting from a vacuum source, exits radially outside the feed bore from the filling nozzle at the end portion closest to the cartridge to form a closable outlet opening.

It is preferable to provide an annular slide valve which can be displaced beyond at least one outlet opening, and which has at least one outlet bore for alignment with the outlet opening.

It is also expedient to provide several outlet openings of vacuum channels distributed around the periphery of the feed bore for the mass, with the slide valve being contrived as a rotary slide valve that can be rotated concentrically around the feed bore, and that has a number of correspondingly disposed outlet bores. The rotary slide valve can be formed by an end element of a sleeve which is rotatably disposed inside the feed bore.

The sealing sleeve preferably has an annular seal at the end closest to the cartridge.

The centre element inside the cartridge neck is preferably curved like a dome, and the end portion of the filling nozzle closest to the cartridge has a correspondingly indrawn hollow, with the feed channel at the centre.

BRIEF DESCRIPTION OF THE DRAWINGS

Preferred examples of embodiments will be explained in more detail below with reference to the enclosed drawings, in which.

DETAILED DESCRIPTION

Figure 1:
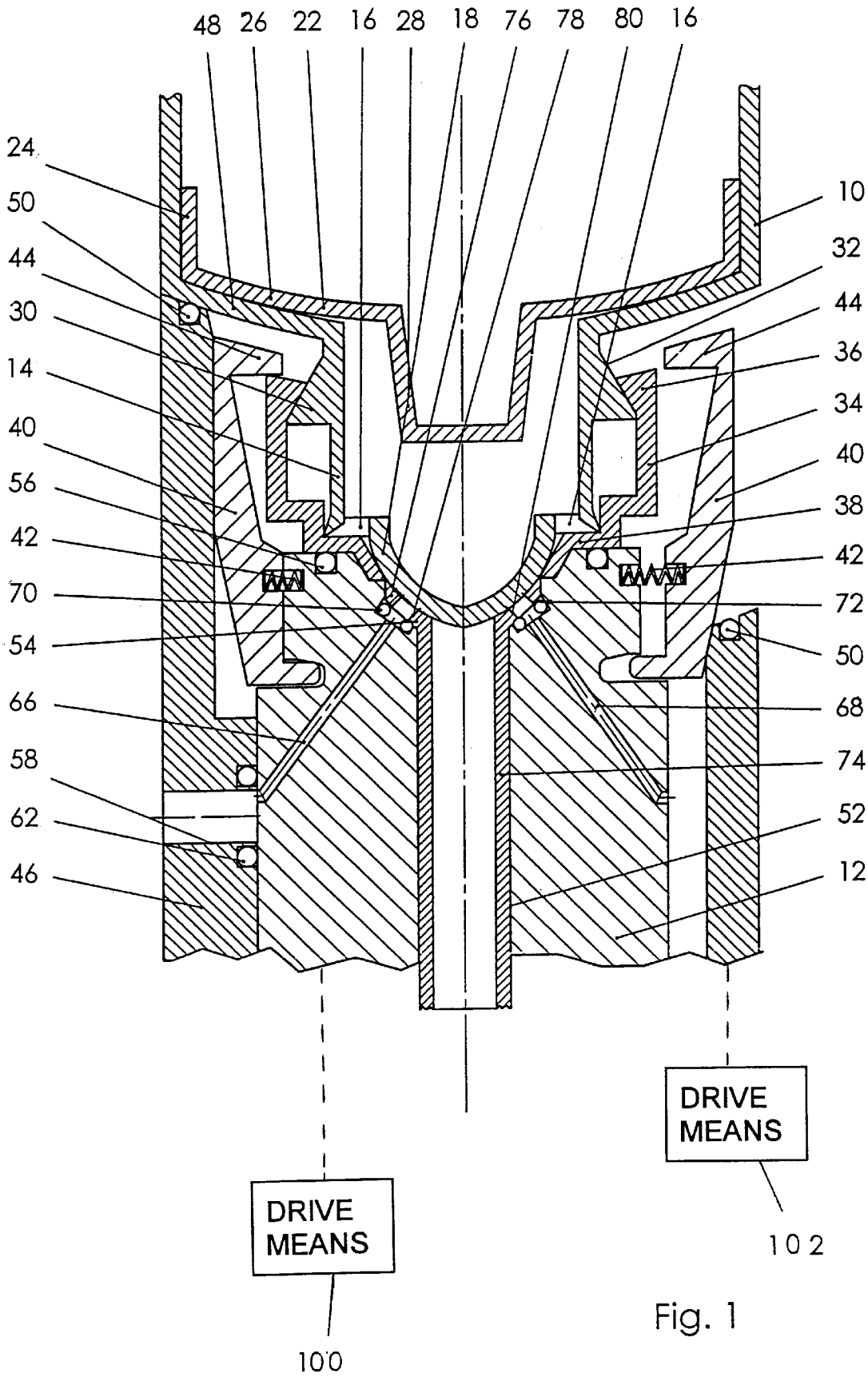
FIG. 1 is a diagrammatic longitudinal section through the outlet-ended end portion of a cartridge and the adjoining portion of a filling device according to the invention, showing different stages in a filling operation on the right and left.

As already mentioned, FIG. 1 shows a vertical section of the transition area between a cartridge 10 awaiting filling and a filling nozzle 12. The overall shape of cartridge 10 resembles a bottle, and it has a neck 14 which is directed downwards in the position shown in FIG. 1, in the centre of which there is a centre element 18 which is connected with the inside wall of neck 14 by means of stems 16 disposed around the periphery. This forms an annular outlet opening 20 between neck 14 and centre element 18. Centre element 18 is curved like an arch, i.e. downwards in FIG. 1.

Inside cartridge 10 one can see a piston 22, which can be described overall as shaped like a pot, and which comprises a peripheral cylindrical circumferential surface 24 that abuts against the inside surface of cartridge 10, a base 26 that is curved slightly downwards in FIG. 1 and a truncated cone-shaped recess 28 in the centre of base 26 which projects downwards into neck 14. The piston serves to press out the doughy material not shown in FIG. 1 and is shown in FIG. 1 in its deepest end position inside the cartridge, in which position the filling operation can start.

On the outer surface of neck 14 of the cartridge there is a peripheral collar 30 whose outer surface 32 tapers towards the end of the neck, i.e. diverges downwards in FIG. 1. In FIG. 1, the top edge 36 of cylindrical valve cap 34 engages with collar 30. The inside surface of this edge also tapers in line with the outer surface 32 of the collar. At the bottom end of the circumferential surface (not shown) of valve cap 34, there is an inwardly directed annular flange 38 which initially runs inwards horizontally and then, after a bend, tapers downwards and inwards. Annular flange 38 seals outlet opening 20 of the cartridge when valve cap 34 adopts the position shown in FIG. 1.

Figure 2:
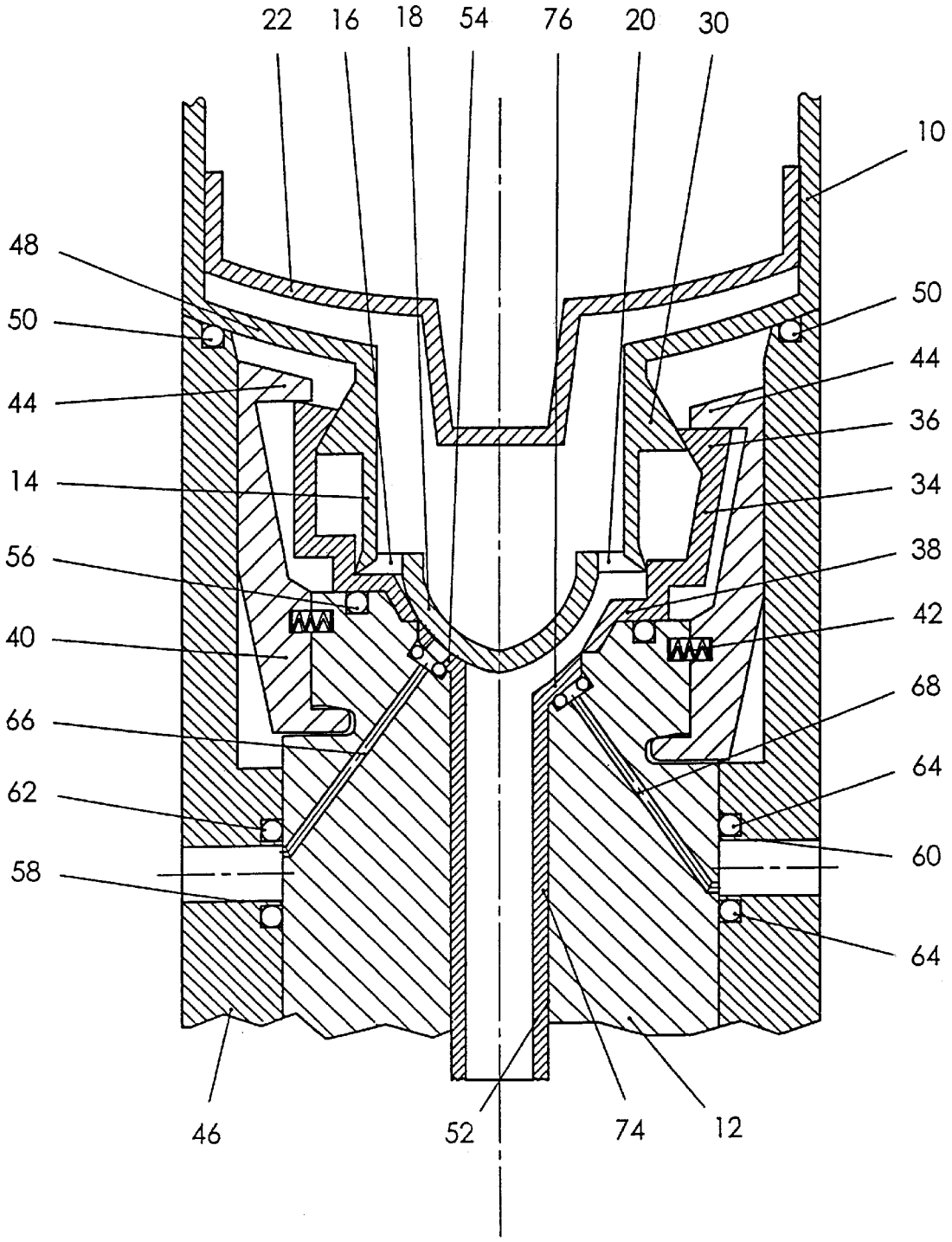
FIG. 2 is a corresponding longitudinal section which also shows two different stages in a filling operation on the right and left sides.

The valve cap can be made entirely from an elastic material and hence can be radially expanded to such a degree that it can be pushed downwards along neck 14 out of the position shown in FIG. 1 into the position shown on the right in FIG. 2. Alternatively, or additionally, the valve cap can be provided with a number of radial slits in the region of the top edge 36 to ensure radial expansibility. The interacting tapered surfaces of collar 30 and top edge 36 of the valve cap ensure that valve cap 34 is pretensioned in an upwards direction in the diagram, i.e. in the closed position.

When a cartridge is used, valve cap 34 is displaced into the lower position, i.e. the one in which outlet opening 20 opens, by the pressure exerted on the pasty mass by piston 22. This pressure is not available during the filling operation and so valve cap 34 has to be opened by other means.

For this purpose a number of claws are distributed around the periphery of the top portion of filling nozzle 12. These claws 40 are pressed outwards by springs 42 in a manner which is not described in any more detail, so that they adopt the position shown on the right in FIG. 1. The claw 40 shown on the left side of FIG. 1 is pushed inwards so that an inwardly directed hook-shaped projection 44 engages from above with valve cap 34.

Claws 40 automatically move inwards when a sealing sleeve 46 enclosing filling nozzle 12 is pushed upwards in FIG. 1. The left half of FIG. 1 shows sealing sleeve 46 in its pushed-up position and on the right, in its lower starting position. In its higher end position, sealing sleeve 46 abuts against the front 48 of cartridge 10, as shown on the left of FIG. 1, thereby enclosing the entire filling zone at the transition from filling nozzle 12 to cartridge 10. Inserted in the top front edge of sealing sleeve 46 there is a peripheral seal 50 which ensures a leak-proof join with the cartridge. The purpose of this seal will be explained below. Both sealing sleeve 46 and filling nozzle 12 have separate drive means for upwards and downwards displacement. These drive means 10*a* and 10*b*, respectively can be automatic, semi-automatic or, for small plants, possibly manual.

Filling nozzle 12 has a cylindrical profile with a concentric feed bore 52 inside. The top end of feed bore 52 opens out in a downwardly shaped hollow 54, whose shape matches the curve of centre element 18. Outside hollow 54, at the front of filling nozzle 12, there is a peripheral seal 56, which abuts against the underside of annular flange 38 of valve cap 34 when the filling nozzle and the cartridge meet up.

It has already been mentioned that in some cases it can be expedient to conduct the filling operation under vacuum conditions. For this purpose sealing sleeve 46 has radial bores 58,60, whose outlet openings on the side of filling nozzle 12 are surrounded by seals 62,64. A vacuum source (not shown) is connected to bores 58,60 from the outside. When sealing sleeve 46 is pushed completely forwards against the cartridge, bores 58,60 coincide with vacuum channels 66,68, which run diagonally from outside through filling nozzle 12 into hollow 54 at the cartridge end of filling nozzle 12. The outlet openings of vacuum channels 66,68 in hollow 54 are surrounded by seals 70,72. The entire transition area between cartridge 10 and filling nozzle 12 can be airtightly sealed off by sealing sleeve 46 together with its seal 50 and cartridge 10.

Inside feed bore 52 of filling nozzle 12 there is a rotatable sleeve 74 which widens out like a bell inside hollow 54 at the outlet end of sleeve 74, thereby abutting against the base of hollow 54. The bell-shaped widening of rotatable sleeve 74 forms an annular slide valve 76 which has a number of bores 78,80 which coincide with the outlet openings of vacuum channels 66,68 when sleeve 74 adopts a predetermined angular position. This angular position is shown in FIG. 1 and in the left half of FIG. 2. If, however, sleeve 74 is rotated, the outlet openings of vacuum channels 66,68 can be closed by means of annular slide valve 76, as shown in the right half of FIG. 2.

The mode of functioning of the device according to the invention will now be described.

Firstly, a cartridge 10 requiring filling is placed against filling nozzle 12 as shown in the right half of FIG. 1, in such a manner that centre element 18 lies in hollow 54, as shown in FIG. 1. Sealing sleeve 46 is then pushed forward towards cartridge 10 until the seal 50 at the front edge of sealing sleeve 46 abuts against the front (not designated) of cartridge 10. As sealing sleeve 46 is pushed forwards, an inside tapered surface (not designated) runs up against a cam surface (not designated) of claws 40, and pushes the latter inwards, whereupon the hook-shaped projections 44 engage with the cartridge end of valve cap 34.

Filling nozzle 12 is then drawn back, or sealing sleeve 46 is pushed further forwards, as shown in the right half of FIG. 2. As a result, the cartridge-ended edge 36 of valve cap 34 diverges and is pulled by claws 40 into a position in which it uncovers annular outlet opening 20. In this position the air is extracted from the inside of cartridge 10 in vacuum mode, thereby drawing piston 22 against the inside of the front 48 of the cartridge. The filling operation is not hampered by air trapped in the cartridge.

In the next step, sleeve 74 inside feed bore 52 is rotated until annular slide valve 76 at the end of sleeve 74 seals off vacuum channels 66,68, as shown in the right half of FIG. 2. The filling operation can now start. By rotating sleeve 74 one can ensure that the filling material is not sucked into the vacuum system.

Once the filling operation is finished, the filling nozzle is again pushed forward towards the cartridge, sealing sleeve 46 is pulled back into the position shown in the right half of FIG. 1, and the cartridge can be removed.

It is evident that the expense associated with the structure of the device of the invention is only minimal, making it financially viable to use even for filling e.g. small batches of special colours. Empty cartridges can be refilled. The filling operation is conducted through the outlet opening. No supplementary inlet opening is required.

The special advantages of filling under vacuum have already been mentioned. Used, even partially empty cartridges can be refilled without removing the piston and without any risk of undesirable air bubbles. This means that cartridges no longer have to be disposed of as soon as they have been emptied.

What is claimed is:

1. A filling device for cartridges with a cartridge neck having annular outlet opening inside thereof and a fixed center element at a center thereof, and a valve cap that is shiftably disposed on the neck and which, in a first position into which the valve cap is pretensioned, covers the annular outlet opening by means of an inwardly projecting annular flange of the valve cap and, in a second position, uncovers the annular outlet opening, the filling device comprising:

a cylindrical filling nozzle with a concentric feed bore for containing filling material inside thereof, a sealing sleeve that concentrically encloses said filling nozzle and which is longitudinally displaceable in relation to the filling nozzle, claws on an end portion of said filling nozzle for contacting a cartridge, and for gripping the valve cap of the cartridge and moving the valve cap into the second position as a result of the filling nozzle being pulled back, and a drive assembly for independently longitudinally displacing at least one of the filling nozzle and the sealing sleeve.

2. The filling device of claim 1, wherein said claws have hook-like projections, and a cam surface on a radial outer side thereof which is engaged when the sealing sleeve is displaced so that the claws are pushed inwards towards the cartridge by the sealing sleeve, and engage behind the valve cap by means of the hook-like projections.

3. The filling device of claim 2, wherein the claws are elastically pretensioned outwards.

4. The filling device of claim 2, wherein the filling nozzle has an annular seal in an end portion thereof which is intended to come into contact with the cartridge, and which acts together with a front portion of the valve cap.

5. The filling device of claim 2, further comprising at least one vacuum channel which, starting from a vacuum source, exits radially outside said concentric feed bore from said filling nozzle at an end portion of said filling nozzle closest to the cartridge to form a closable exit opening.

6. The filling device of claim 1, wherein the claws are elastically pretensioned outwards.

7. The filling device of claim 1, wherein the filling nozzle has an annular seal in an end portion thereof which is intended to come into contact with the cartridge, and which acts together with a front portion of the valve cap.

8. The filling device of claim 7, further comprising at least one vacuum channel which, starting from a vacuum source, exits radially outside said concentric feed bore from said filling nozzle at an end portion of said filling nozzle closest to the cartridge to form a closable exit opening.

9. The filling device of claim 1, further comprising at least one vacuum channel which, starting from a vacuum source, exits radially outsides aid concentric feed bore from said filling nozzle at an end portion of said filling nozzle closest to the cartridge to form a closable exit opening.

10. The filling device of claim 9, wherein there is at least one annular outlet opening, and further comprising an annular slide valve which can be displaced relative to the at least one annular outlet opening, and which has at least one bore for alignment with the at least one annular outlet opening.

11. The filling device of claim 10, wherein there are several outlet openings of said vacuum channels distributed around a periphery of said feed bore, and said slide valve is contrived as a rotary slide valve that can be rotated concentrically around said feed bore.

12. The filling device of claim 11, further comprising a rotating sleeve disposed inside said feed bore, and wherein said slide valve forms an end element of said rotating sleeve.

13. The filling device of claim 12, wherein said sealing sleeve has a seal at an end thereof closest to the cartridge.

14. The filling device of claim 12, wherein the center element inside the cartridge neck has a dome like curvature, and there is a hollow with a matching cross-section at an end portion of said filling nozzle used to accommodate the cartridges, into which said feed bore and said at least one vacuum channel open out.

15. The filling device of claim 11, wherein said sealing sleeve has a seal at an end thereof closest to the cartridge.

16. The filling device of claim 11, wherein the center element inside the cartridge neck has a dome like curvature, and there is a hollow with a matching cross-section at an end portion of said filling nozzle used to accommodate the cartridges, into which said feed bore and said at least one vacuum channel open out.

17. The filling device of claim 10, wherein said sealing sleeve has a seal at an end thereof closest to the cartridge.

18. The filling device of claim 10, wherein the center element inside the cartridge neck has a dome like curvature, and there is a hollow with a matching cross-section at an end portion of said filling nozzle used to accommodate the cartridges, into which said feed bore and said at least one vacuum channel open out.

19. The filling device of claim 9, wherein said sealing sleeve has a seal at an end thereof closest to the cartridge.

20. The filling device of claim 9, wherein there center element inside the cartridge neck has a dome like curvature, and there is a hollow with a matching cross-section at an end portion of said filling nozzle used to accommodate the cartridges, into which said feed bore and said at least one vacuum channel open out.

* * * * *

UNITED STATES PATENT AND TRADEMARK OFFICE

CERTIFICATE OF CORRECTION

PATENT NO. : 6,196,282 B1
DATED : March 6, 2001
INVENTOR(S) : Renko Möllers

It is certified that error appears in the above-identified patent and that said Letters Patent is hereby corrected as shown below:

Column 4,
Line 3, after "means" insert -- 102 and 100, respectively --.

Column 6,
Line 53, change "there" to -- the --.

Signed and Sealed this

Second Day of October, 2001

*Attest:*

Nicholas P. Godici

NICHOLAS P. GODICI
*Acting Director of the United States Patent and Trademark Office*

*Attesting Officer*